United States Patent [19]

Wittmann et al.

[11] 4,214,406

[45] Jul. 29, 1980

[54] DIMENSIONALLY STABLE SUPPORT STRUCTURE

[75] Inventors: Alois Wittmann, Palos Verdes; Ronald J. McGrath, Covina, both of Calif.

[73] Assignee: Hughes Aircraft Company, Culver City, Calif.

[21] Appl. No.: 973,492

[22] Filed: Dec. 26, 1978

[51] Int. Cl.[2] ..... E04H 9/00

[52] U.S. Cl. ..... 52/1; 350/310

[58] Field of Search ..... 52/573, 1; 248/DIG. 1; 350/310; 33/125 T, DIG. 19

[56] References Cited

U.S. PATENT DOCUMENTS

| | | | |
|---|---|---|---|
| 3,528,206 | 9/1970 | Baird | 350/310 UX |
| 3,675,376 | 7/1972 | Belew | 52/1 |
| 4,074,473 | 2/1978 | Nelson | 52/1 |

*Primary Examiner*—Price C. Faw, Jr.
*Assistant Examiner*—Carl D. Friedman
*Attorney, Agent, or Firm*—John Holtrichter, Jr.; William H. MacAllister

[57] ABSTRACT

There is herein described a support structure for antennas, optical systems and the like which are generally subject to non uniform dimensional changes due to temperature variations and gradients in the support structure material, the invention overcoming such dimensional changes by combining the use of a material having a low coefficient of thermal expansion and the use of a heat pipe as an integral part of the aforementioned structural member for isothermalization, to reduce the distortion resulting from residual non-zero coefficient of thermal expansion.

1 Claim, 2 Drawing Figures

DIMENSIONALLY STABLE SUPPORT STRUCTURE

BACKGROUND OF THE INVENTION

The background of the invention will be set forth in two parts.

1. Field of the Invention

This invention relates to dimensionally stable support structures and more particularly to such structures for support of optical sensors, large antennas, and the like.

2. Description of the Prior Art

Advanced satellite missions and also ground-based applications require extremely precise and dimensionally stable structures for support of optical sensors or antennas, for example. In the past, various techniques have been developed in efforts to overcome the problem which generally stems from temperature gradient effects in materials, causing non uniform expansion or contraction.

One such technique is designed to compensate for temperature gradient effects across the cross sectional dimension of hollow tubular members. Here, holes are drilled or otherwise provided along the surface of a side of the structure which generally faces a heat source, such as the sun. The purpose of this is so that the sun's energy that passes through the holes heats up the opposite side of the tubular member and lessens the temperature gradient across the member. This, of course, helps to lessen the rate of dimensional change in the areas of the holes. However, in all areas of the structure not immediately adjacent to the holes, there is no compensation. The average temperature of such a member is not reduced by this scheme and therefore distortions are still high. In addition, such a scheme makes it very difficult to even predict what the overall dimensional distortions will be, not to mention the weakening of the structure by the holes.

Another technique is to try to provide longitudinal stability in support structures by using materials, such as Invar which exhibit relatively low coefficients of thermal expansion. However, where the support member has any significant longitudinal dimension, the temperature gradient along the length of the member will indeed be significant and consequently detrimental to dimensional stability.

Unlike the prior art, the present invention utilizes a novel technique for providing temperature insensitivity to support structures by combining the use of a material such as a graphite composite, for example, with an integral heat pipe as a thermal control device which ensures negligible temperature gradients.

SUMMARY OF THE INVENTION

In view of the foregoing factors and conditions characteristic of the prior art, it is a primary object of the present invention to provide an improved dimensionally stable support structure.

Another object of the present invention is to provide a relatively low cost, dimensionally stable support structure for large antennas, optical sensors and the like.

Still another object of the present invention is to provide a simple yet effective dimensionally stable support structure that does not employ structure-weakening schemes to lessen temperature gradients within the support structure.

In accordance with an embodiment of the present invention, a dimensionally stable support structure for supporting antennas, optical sensors, and the like includes a first structural material having a predetermined coefficient of thermal expansion, and a second material having a lesser coefficient of thermal expansion bonded to the first structural material. The invention also includes a heat pipe integrally combined with the structure materials for reducing the temperature gradient through and along the support structure. The heat pipe encasing material may be different from the load bearing structure material.

The coefficient of thermal expansion of the first structural material may be positive, and that of the second material may be negative. For example, the invention may take the form of a triangular support having a thin-walled steel heat pipe which is graphite fiber wrapped for structural reinforcement and control of thermal expansion.

The features of the present invention which are believed to be novel are set forth with particularity in the appended claims. The present invention, both as to its organization and manner of operation, together with further objects and advantages thereof, may best be understood by making reference to the following description taken in conjunction with the accompanying drawing in which like reference characters refer to like elements in the several views.

DESCRIPTION OF THE PREFERRED EMBODIMENTS

Figure 1:
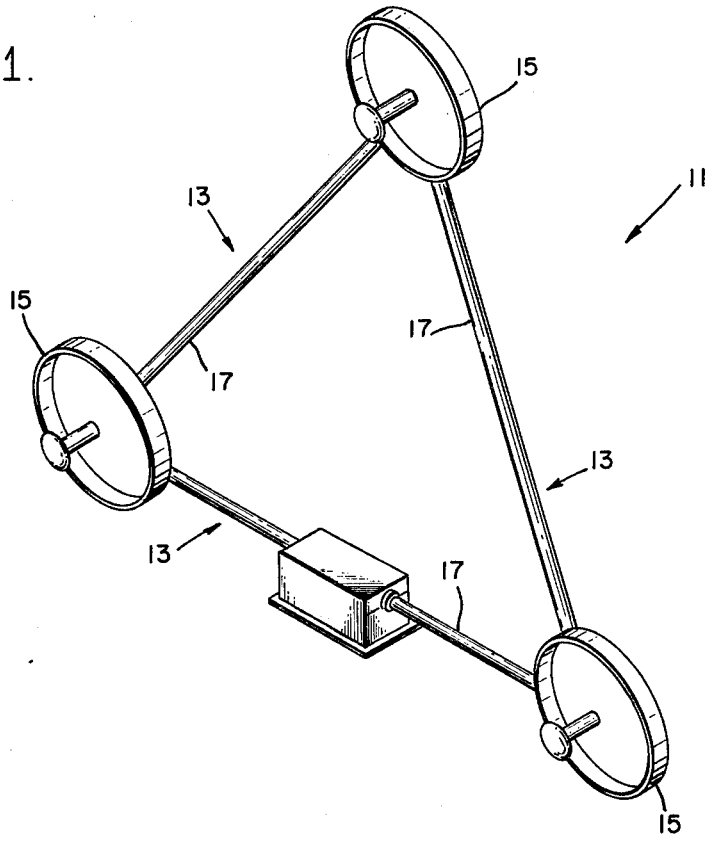
FIG. 1 is a perspective illustration of a triangular support for an antenna interferometer system, the support structure incorporating temperature insensitive though light-weight support design in accordance with the present invention.

Referring now to the drawing and more particularly to FIG. 1, there is shown an interferomter system 11 utilizing a triangular structure 13 supporting three conventional interferometer antennas 15 at its extremities. The support structure 13 uniquely incorporates thin-walled heat pipe sections 17.

Figure 2:
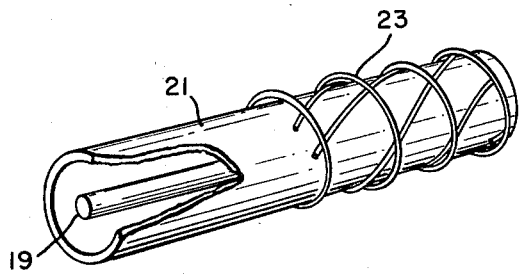
FIG. 2 is a perspective view, partially broken away, of a portion of the support structure in FIG. 1.

Preferably, the thin-walled heat pipe section liners 17 include a conventional heat pipe wick 19 supported by conventional means within a thin-walled outer metal heat pipe case 21. Wrapped around the thin-walled case 21 is a graphite fiber structure 23 for structural reinforcement and control of thermal expansion. An enlarged view of a portion of a heat pipe section 17 is shown in FIG. 2.

A coefficient of thermal expansion ($\alpha$) for a graphite fiber reinforced heat pipe depends on the thickness (t), Young's modulus (E) and coefficients of expansion of both the metallic substrate and the graphite composited as expressed by $$\alpha = \frac{\alpha_{GR} + \alpha_{HP}(tE)_{HP}/(tE)_{GR}}{1 + (tE)_{HP}/(tE)_{GR}}$$

The graphite composite expansion ($\alpha_{GR}$) can be tailored and even made to be negative by proper fiber alignment along the heat pipe. It is theoretically possible to balance thermal expansion of a metallic heat pipe and achieve zero support structure expansion. However, as a practical matter, variation in composite material expansion with temperature as well as dimensional fabrication tolerances will allow only to approach a zero expansion design. Therefore, according to the invention, an integral heat pipe structure 17 is used to provide negligable temperature gradients-through gradients as well as along a structure.

The following table compares predicted dimensional stability of the support structure 13 as measured by ($\Delta T$), the product of thermal expansion and temperature change. It can be seen from the table that the combination of low expansion graphite fiber 23 with a thin-walled steel heat pipe 21 offers an order of magnitude better performance than may be achieved otherwise.

| QUANTITY | GRAPHITE (OR INVAR) ALONE | HEAT PIPE ALONE | INVENTIVE COMBINATION |
|---|---|---|---|
| Expansion, Coef. $\alpha$, $^{8}10^{-6}$/°F. | 0.5 | 5.0 | 0.5 |
| Temp. Gradient $\Delta T$, °F. | 0.3 | 0.01 | 0.01 |
| $\alpha\Delta T$, $10^{-6}$ | 0.15 | 0.05 | 0.005 |

From the foregoing, it should be evident that there has herein been described an improved dimensionally stable support structure useful for support of large antennas, optical sensors, and the like.

It should be understood that the materials used to fabricate the various embodiments of the invention are not critical and any material exhibiting similar desired characteristics may be substituted for those mentioned.

Although the present invention has been shown and described with reference to particular embodiments, nevertheless various changes and modifications which are obvious to persons skilled in the art to which the invention pertains are deemed to lie within the spirit, scope and contemplation of the invention.

What is claimed is:

1. A dimensionally stable support structure for supporting antennas, optical systems, and the like, comprising:

A first structural material having a predetermined coefficient of thermal expansion;

A second structural material having a negative lesser coefficient of thermal expansion bonded to said first structural material; and Heat pipe structural means integrally combined with said materials for reducing the temperature gradient through and along said support structure.

* * * * *